US005345615A

United States Patent [19]

Garofalo

[11] Patent Number: 5,345,615

[45] Date of Patent: Sep. 13, 1994

[54] WIDE VIEWFIELD UNDERWATER MASK

[75] Inventor: Gianni Garofalo, Genova, Italy

[73] Assignee: HTM Sport S.p.A., Genova, Italy

[21] Appl. No.: 89,865

[22] Filed: Jul. 9, 1993

[51] Int. Cl.[5] ..... A61F 9/02

[52] U.S. Cl. ..... 2/430; 351/43; 351/61

[58] Field of Search ..... 2/430, 428, 429, 439, 2/431, 432, 440, 436; 351/43, 61

[56] References Cited

U.S. PATENT DOCUMENTS

| | | | |
|---|---|---|---|
| 2,276,102 | 3/1942 | Schwartz | 351/61 X |
| 3,336,599 | 8/1967 | Gatti et al. | 2/439 |
| 3,671,976 | 6/1972 | Johnson et al. | 2/430 |
| 3,944,345 | 3/1976 | Decorato | 351/43 |
| 5,138,723 | 8/1992 | Bolle | 2/430 |

FOREIGN PATENT DOCUMENTS 893643 8/1944 France .

*Primary Examiner*—Peter Nerbun
*Attorney, Agent, or Firm*—Sheridan Ross & McIntosh

[57] ABSTRACT

This invention relates to an underwater mask which has on the front two plates made of a transparent material for front vision, and two further transparent plates placed beneath the former and forming an angle greater than 90° and less than 180° therewith. The second pair of clear plates afford peripheral vision down the diver's pectoral region.

5 Claims, 3 Drawing Sheets

WIDE VIEWFIELD UNDERWATER MASK

FIELD OF THE INVENTION

The present invention relates to underwater masks, and more particularly, to underwater masks providing expanded field of views in the sideward and pectoral directions.

BACKGROUND OF INVENTION

Underwater masks are designed to provide scuba divers with a clear view of their surroundings.

Of paramount importance is the field of vision afforded by the mask. In fact, the diver is not only to see in front of him but also to gain an all-around view both in the sideward directions and in the pectoral direction, where a number of gauges and controls, such as the cummerbound of the Buoyancy Compensating Device (BCD), the weight belt, inflation system, etc., would usually be found, especially when scuba diving equipment is used.

Underwater masks currently in use have two front plates made of a transparent material, such as a glass or a plastics material, or alternatively a single full-face transparent plate or pane.

Such masks do provide front vision. The width of the viewfield may be increased by expanding the areas of the transparent plates and bringing them closer to the eye, but there remain restrictions to the peripheral vision.

There are several proposals for improving the peripheral vision.

French Patent No. 893,643 discloses a mask having a single pane for front vision which is positioned perpendicularly to the user's sight axis. In addition, the pane holder, being basically tubular in shape, is made of a transparent material.

This solution only expands the diver's viewfield to a limited extent because it takes into account neither the optical properties of the holder nor the lay of the holder walls relative to the eyes.

Additionally, the use of a single front transparent pane makes it difficult to impart it with special optical properties, such as a positive optical diopters for the shortsighted or a negative one for the longsighted.

U.S. Pat. No. 3,671,976 (Johnson et al.) discloses a mask having a single transparent pane mounted frontally and conforming with the face contour at the mask sides, said pane being located as close as possible to the eyes.

That invention provides a possible solution to the problem of obtaining adequate side vision, but fails to ensure good peripheral vision in the pectoral direction.

SUMMARY OF THE INVENTION

This invention relates to an underwater mask which can provide expanded viewfield for the user, especially as regards peripheral vision on the pectoral region.

Said mask comprises a main body having, on its forward portion, a base frame which provides support for two eye-plate holding half-frames, each holding a first front plate made of a transparent material and placed perpendicularly to the user's sight axis and a second transparent plate, for pectoral vision, placed beneath said first front transparent plate and forming therewith an angle greater than 90° and less than 180°.

A prime object of this invention is that it expands the user's vision, specifically toward his pectoral region, without forcing him into inconvenient movements.

Another object of this invention is that, instead of simple transparent plates, it can mount either positive or negative sight correcting lenses, and this only where they are needed, that is either frontally or down toward the pectoral region, or both.

A further object of this invention is that flat transparent plates can be used, which are easier to manufacture and more economical.

Still another object of this invention is that the use of interfit frames and rigid and resilient sealing rings for securing said transparent plates in interfit relationship, without permanent adhesive sealant, makes possible transparent plate replacement and makes for easier mass production of the underwater mask and attendant economical benefits.

These and other object of this invention will become more clearly apparent from the drawings and associated description of a preferred embodiment of the invention.

DESCRIPTION OF THE PREFERRED EMBODIMENT

Figure 1:
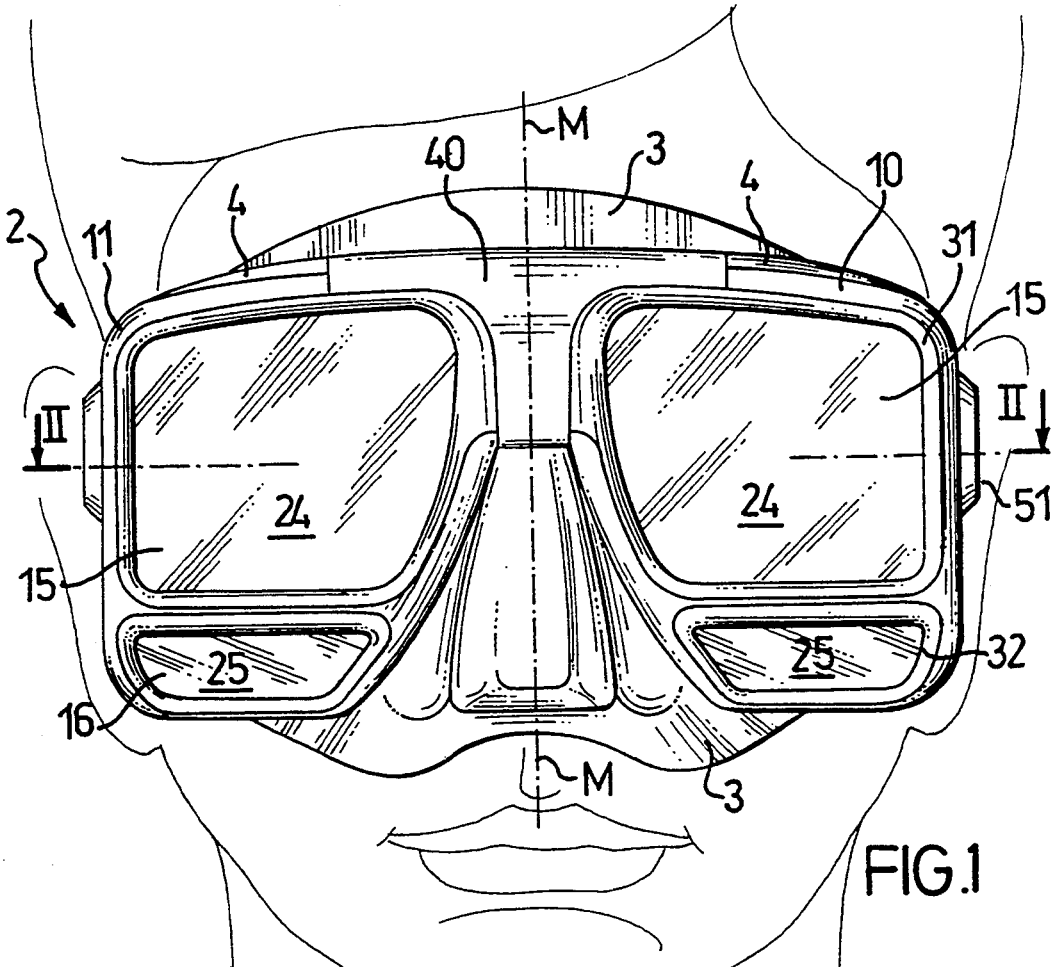
FIG. 1 is a front view of the underwater mask.
Figure 2:
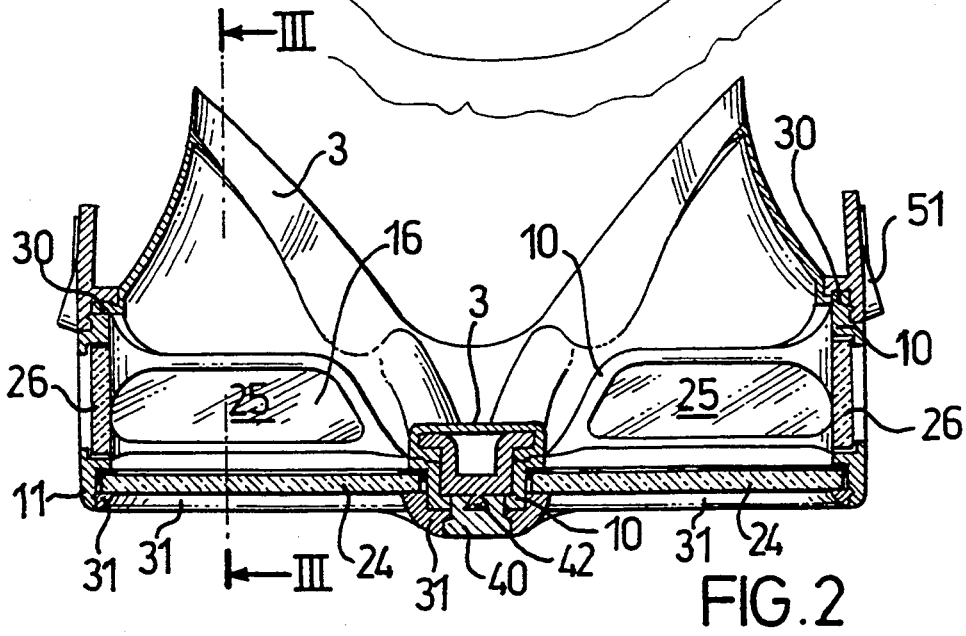
FIG. 2 is a cross-sectional view of the invention, taken along line II—II in FIG. 1.

With reference to the drawings, an underwater mask forming the subject-matter of this invention is generally shown at 1. Said mask 1 comprises a main body 2 which has a resilient member 3 conforming, at its rearward portion, with the diver's face, in front of his eyes and nose. The mask is held against the face by a resilient strap 50 which surrounds the diver's head and is conventionally fastened to the lateral extremes 51 of the main body 2.

Said base frame 4 is symmetrical about the vertical centerline M—M. It has two front openings 5, 6 lying in a substantially perpendicular plane to the sight axis 0—0 (FIG. 3) and being defined by the contour formed by the respective upper *7a*, *8a*, lower *7b*, *8b*, and inner side *7c*, *8c* and outer side *7d*, *8d* edges.

Recesses 9 are formed in said edges.

The base frame 4 provides support for two transparent eye-plate holding half-frames 10 and 11, also symmetrical about said vertical centerline M—M and aligned to the two front openings 5, 6 of said frame 4. Each eye-plate holding half-frame 10, 11 has, on its outer edge 12, 13, a plurality of projections or teeth 14 which fit into their corresponding recesses 9 to secure said eye-plate holding half-frames 10, 11 on said base frame 4.

A tight fit between the base frame 4 and the half-frames 10, 11 is ensured by the edge 30 of the elastic member 3 intervening between it and the half-frames 10 and 11 to act as a seal.

A further securing element 40 consists of a T-shaped element, being symmetrical about the vertical centerline M—M and having a longitudinal runway 41 which fits into a rail 42 located on the frame 4 at said centerline M—M.

Said securing element 40 has a projecting edge 43 confronting the half-frames 10, 11 which are clamped between it and the inner edges 7, 8 of the openings 5, 6 of the frame 4.

The half-frames 10 and 11 are mirror images of each other, and accordingly, only one of them will be described hereinafter.

According to a preferred embodiment of the invention, the eye-plate holding half-frame 11 has a first opening 15 located frontally, a second opening 16 extending toward the lower edge 8*b* of the base frame, a third opening 17 located sideways and outwardly relative to said first and second openings 15, 16.

Said openings 15, 16, 17 are separated by elements of the half-frame 11 itself; in particular, the first opening 15 and second opening 16 are separated by an element 18, the first opening 15 and third opening 17 are separated by an element 19, and the second opening 16 and third opening 17 are separated by an element 20.

Said openings 15, 16, 17 are each formed with an edge contoured to present a ledge 21, 22, 23, respectively, for the transparent plate support.

The ledge-shaped edges 21 and 22 of the front opening 15 and the opening 16, respectively, have each a plurality of recesses 27.

Said recesses 27 are in the form of slits on the opposite element of the half-frame 18 and two elements 28, 29 of the half-frame 11 from the element 18 and being part of the edge 21 of the opening 15 and the edge 22 of the opening 16, respectively.

Figure 3:
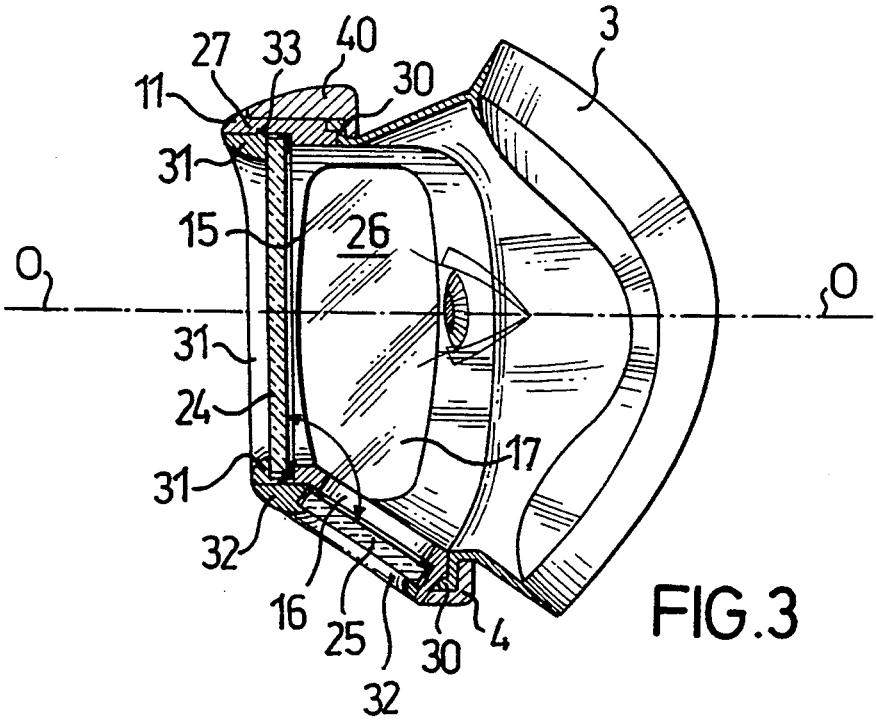
FIG. 3 is a cross-sectional view of the invention, taken along line III—III in FIG. 2.
Figure 4:
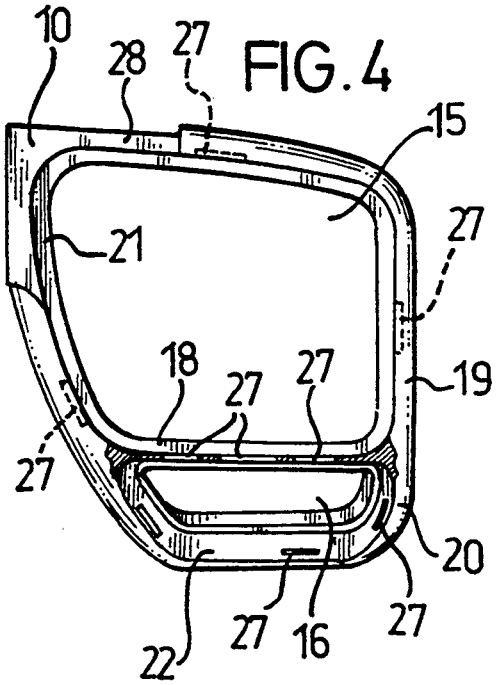
FIG. 4 is a cut-away front view of the eye-plate holding half-frame of the underwater mask.
Figure 5:
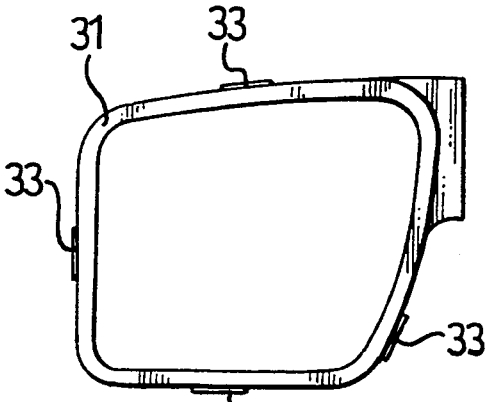
FIG. 5 is a front view of the sealing ring for a front transparent plate.
Figure 6:
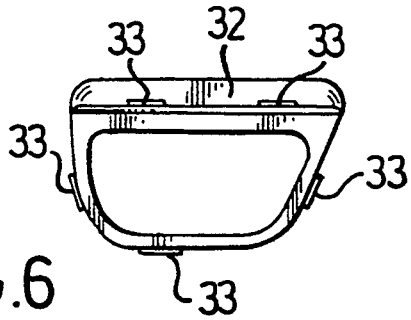
FIG. 6 is a front view of the sealing ring for a transparent plate intended for pectoral vision.
Figure 7:
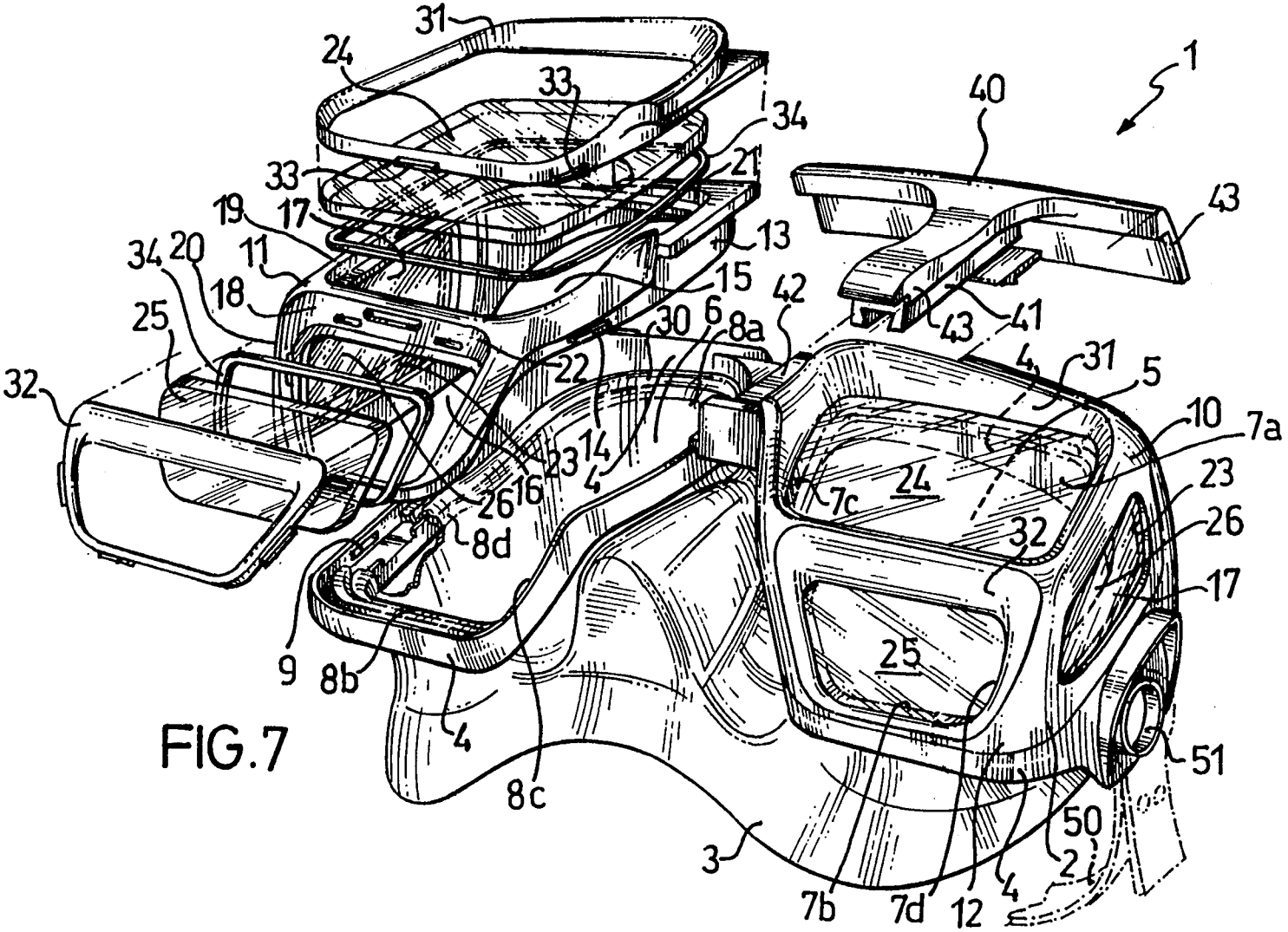
FIG. 7 is a partly exploded isometric depiction of the underwater mask.

The edge 21 of the first opening 15 forms a seat for a first front plate 24 made of a transparent material. Said transparent plate 24 is substantially perpendicular to the diver's sight axis 0—0 (FIG. 3).

Likewise, the edge 22 of the opening 16 forms a seat for a second transparent plate 25, and the edge 23 of the third opening forms a seat for a third clear plate 26.

The second transparent plate 25 locates beneath said first clear plate 24 and forms an angle greater than 90° and less than 180° therewith. It is arranged for peripheral vision on the diver's pectoral region. The value of said angle depends on the distance between the first transparent front plate and the diver's eye.

Said value will increase reducing said distance.

For example if said distance is equal to 20 mm said angle will be about 135°.

The third transparent plate 26 is located sideways and outwardly relative to said first and second transparent plates 24, 25. It is arranged for peripheral vision in sideward directions.

The third plate is fitted inside the opening 17 from within the half-frame 11 and is secured conventionally on the edge 23.

Said first and second transparent plates 24 and 25 are respectively fitted inside the openings 14 and 15 from without the half-frame 11. They are tightly fitted, each to its respective ledge-shaped edge 21 and 22, using grommets 34, interposed between each transparent plate 24 and 25 and its respective ledge-shaped edge 21 and 22, and sealing rings 31, 32 corresponding to the openings 14, 15, respectively.

The rings 31, 32 are also effective to suppress sharp corner edges on the outer surface of the mask 1, as are due to said transparent plates 24 and 25 being fitted from without the half-frames 10, 11, as well as to enhance the mask appearance.

Said rings 31, 32 match, both in shape and thickness, the edges 21 and 22, respectively, of the openings 14, 15, and are provided with a plurality of outward projections 33 which fit into corresponding recesses 27. Thus, the rings 31 and 32 are secured on the eye-plate holding half-frame 11.

The foregoing description of a preferred embodiment of the invention has been given by way of example and not of limitation. Understandably, many changes and modifications may be made thereunto within the scope of the inventive concept. It is understood that the invention scope should be that defined by the appended claims.

What is claimed is:

1. A wide viewfield underwater mask comprising:

a main body with a resilient member conforming to the diver's face at the eyes and nose area and with a symmetry mid-axis at the nose;

a base frame connected to said resilient member and provided with an opening at each of the diver's eyes, said openings being bound by an upper edge, a lower edge, and inner and outer side edges which define a symmetrical contour about said symmetry mid-axis and lying in a substantially perpendicular plane to the diver's sight axis;

a transparent eye-plate holding half-frame for each of said openings provided with an edge defining a contour fitting within that of the corresponding opening of the base frame;

a first connection means for securing each half-frame tightly on the base frame at its associated opening;

first and second openings on each half-frame bound by respective contour edges;

said first opening lying in a substantially perpendicular plane to said sight axis, and said second opening lying in a plane forming an angle greater than 90° and less than 180°, with that of the first opening and extending toward the lower edge of the corresponding opening of the base frame;

first and second transparent plates respectively fitting within said first and second openings of each half-frame; and a second connection means for securing said first and second transparent plates tightly in their respective first and second openings of each half-frame.

2. An underwater mask according to claim 1, wherein each half-frame includes a third opening bound by respective contour edges lying in a substantially parallel plane to said sight axis and adjacent to the outer side edge of each opening of said base frame and a third transparent plate secured tightly within said third opening.

3. An underwater mask according to claim 1, wherein said first tight connection means for securing each half-frame to its respective opening of the base frame comprises a plurality of recesses formed in the edges defining the contours of said symmetrical openings of the base frame and corresponding teeth projecting from the edges defining the contour of each half-frame which interfit in said recesses and an edge of said resilient member intervening between the base frame and each half-frame to act as a seal.

4. An underwater mask according to claim 1, wherein said second connection means for securing said first transparent plate and said second transparent plate within the first opening and said second opening of each half-frame, respectively, comprises a plurality of recesses formed in the edges which define the contours of said openings at a location away from the ledge for the transparent plate, a ring-like element for each opening, said ring-like opening being provided with edges which define a contour fitting within its respective opening, a plurality of teeth projecting from the edges of the contour of each ring-like element which interfit in said recesses, and a grommet interposed between each transparent plate and their ledges.

5. A mask according to claim 4, wherein said first transparent plate and/or second transparent plate consist of diver's sight correcting lenses.

* * * * *